US008070162B1

(12) United States Patent
Butcher

(10) Patent No.: US 8,070,162 B1
(45) Date of Patent: Dec. 6, 2011

(54) GAME HAVING AN ELECTRONIC INSTRUCTION UNIT

(75) Inventor: Stephen W. Butcher, Monson, MA (US)

(73) Assignee: Hasbro, Inc., Pawtucket, RI (US)

( * ) Notice: Subject to any disclaimer, the term of this patent is extended or adjusted under 35 U.S.C. 154(b) by 1331 days.

(21) Appl. No.: 10/947,736

(22) Filed: Sep. 23, 2004

(51) Int. Cl.
*A63F 1/00* (2006.01)

(52) U.S. Cl. ..... 273/272; 273/292

(58) Field of Classification Search ..... 273/292, 273/272
See application file for complete search history.

(56) References Cited

U.S. PATENT DOCUMENTS

| | | | | |
|---|---|---|---|---|
| 4,171,813 | A | 10/1979 | Kuna et al. | 273/237 |
| 4,240,638 | A | 12/1980 | Morrison et al. | 273/237 |
| 4,363,482 | A | 12/1982 | Goldfarb | 463/9 |
| 4,572,513 | A | 2/1986 | Evans | 273/242 |
| 4,669,728 | A | 6/1987 | Carden | 273/138 A |
| 4,770,416 | A | 9/1988 | Shimizu et al. | 273/1 GC |
| 4,957,291 | A | 9/1990 | Miffitt et al. | 273/153 R |
| 4,969,647 | A | 11/1990 | Mical et al. | 273/85 G |
| 5,009,419 | A | 4/1991 | Streeter | 273/454 |
| 5,011,156 | A | 4/1991 | LaChance, Jr. et al. | 273/237 |
| 5,039,846 | A | 8/1991 | Komaki | 235/1 D |
| D320,624 | S | 10/1991 | Taylor | D21/13 |
| 5,114,153 | A * | 5/1992 | Rosenwinkel et al. | 273/292 |
| 5,120,065 | A * | 6/1992 | Driscoll et al. | 273/237 |
| 5,277,429 | A | 1/1994 | Smith, III | 273/237 |
| 5,411,271 | A | 5/1995 | Mirando | 273/434 |
| D363,320 | S | 10/1995 | Barthelemy et al. | D21/48 |
| 5,465,982 | A | 11/1995 | Rebane | 273/433 |
| 5,478,240 | A | 12/1995 | Cogliano | 434/327 |
| 5,630,754 | A | 5/1997 | Rebane | 463/9 |
| 5,685,776 | A | 11/1997 | Stambolic et al. | 463/46 |
| 5,816,580 | A | 10/1998 | Osborne et al. | 273/454 |
| 5,839,976 | A | 11/1998 | Darr | 473/414 |
| 5,855,513 | A | 1/1999 | Lam | 463/9 |
| 5,893,798 | A | 4/1999 | Stambolic et al. | 463/46 |
| 5,906,369 | A | 5/1999 | Brennan et al. | 273/238 |
| 6,086,478 | A | 7/2000 | Klitsner et al. | 463/35 |
| 6,210,278 | B1 * | 4/2001 | Klitsner | 463/35 |
| 6,540,615 | B2 | 4/2003 | Tanaka et al. | 463/44 |
| 6,848,992 | B2 | 2/2005 | Adams | 463/9 |

(Continued)

OTHER PUBLICATIONS

U.S. Appl. No. 10/941,590, entitled "Electronic Sequence Matching Game and Method of Game Play Using Same," filed Sep. 15, 2004 (47 pages).

(Continued)

*Primary Examiner* — Gene Kim
*Assistant Examiner* — Michael Dennis
(74) *Attorney, Agent, or Firm* — Miller, Matthias & Hull, LLP

(57) ABSTRACT

The present invention is directed to a game having an instruction unit and a deck of game cards, with each card having game indicia. Game cards may be distributed to each participant, and each player in turn comparing the game indicia of the game cards to the game indicia of a top card of a discard pile. The game may further include discarding at least one of the game cards onto the discard pile if the game indicia of the player's game cards corresponds to the game indicia of the top card of the discard pile, and actuating the instruction unit to output a game instruction if the player determines that none of their game cards may be played on the top card. Still further, the game may include the player selecting additional game cards from the deck in response to the game instruction output by the instruction unit.

22 Claims, 10 Drawing Sheets

U.S. PATENT DOCUMENTS

| | | | | |
|---|---|---|---|---|
| 7,513,828 | B2 * | 4/2009 | Nguyen et al. | 463/26 |
| 2001/0009866 | A1 | 7/2001 | Klitsner et al. | 463/35 |
| 2002/0111202 | A1 | 8/2002 | Annis et al. | 463/7 |
| 2004/0036214 | A1 * | 2/2004 | Baker et al. | 273/149 R |
| 2004/0094895 | A1 * | 5/2004 | Nasco | 273/292 |

OTHER PUBLICATIONS

U.S. Appl. No. 11/181,092, entitled "Hand-Held Electronic Game Device," filed Jul. 13, 2005 (29 pages).

U.S. Appl. No. 11/194,508, entitled "Electronic Tag Game and Instruction Unit," filed Aug. 1, 2005 (35 pages).

U.S. Appl. No. 11/421,647, entitled "Game Having an Electronic Instruction Unit with a Mechanical Die Agitator" filed Jun. 1, 2006 (37 pages).

U.S. Appl. No. 11/426,420, entitled "Game Having an Electronic Instruction Unit," filed Jun. 26, 2006 (39 pages).

* cited by examiner

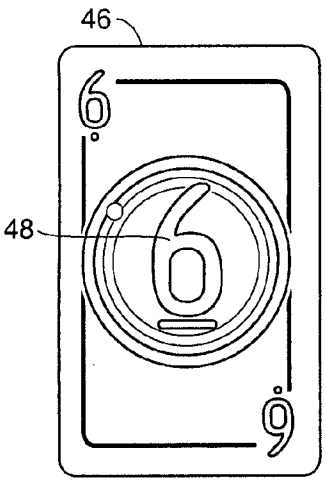
FIG. 2A
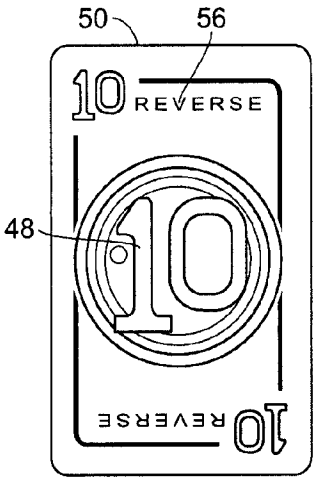
FIG. 2B
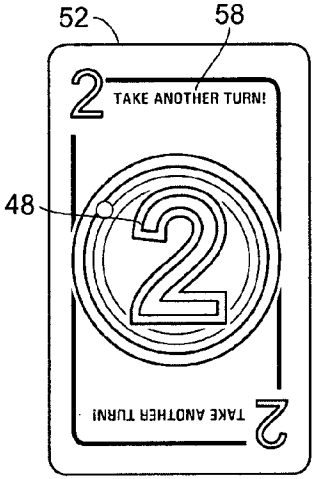
FIG. 2C
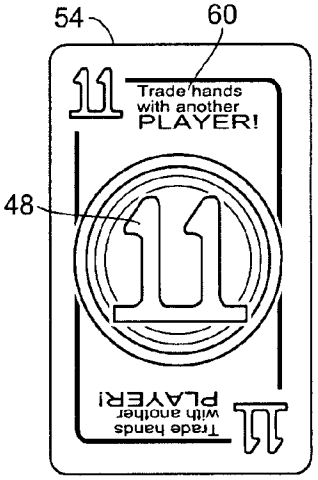
FIG. 2D
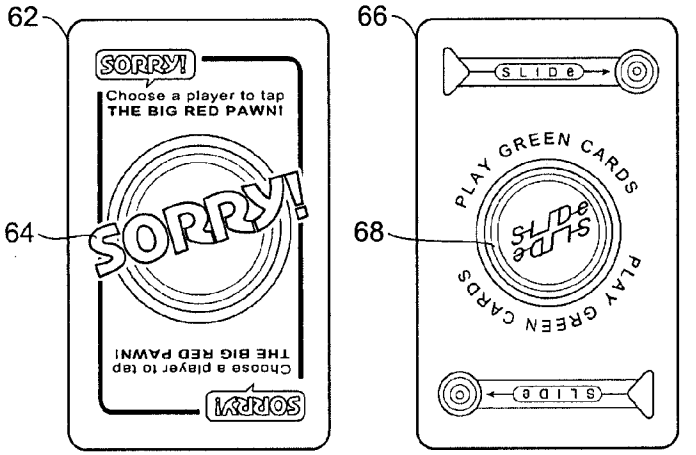
FIG. 2E
FIG. 2F
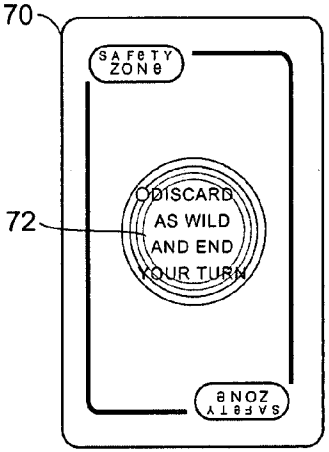
FIG. 2G 122 124 120

| Phrase No. | Phrase |
|---|---|
| 0.1 | Never heard a red pawn talk before? Come on. Take me home. |
| 0.2 | You touch, you buy! |
| 0.3 | Say, I'd look mighty good in that shopping cart. |
| 1 | Welcome to Sorry! Card Revenge. Come on a tap the noggin when you're ready to play. (always followed by 37, 38 or 39) |
| 2 | Sorry . . . (always followed by take 1-3 cards) |
| 3 | I'm really sorry . . . (always followed by take 1-3 cards) |
| 4 | I'm sorry I have to do this, but . . . (always followed by take 1-3 cards) |
| 5 | (drawn out) Soorrry . . . (always followed by take 4-6 cards) |
| 6 | So Sorry . . . (always followed by take 4-6 cards) |
| 7 | Sorry, this may sting a little . . . (always followed by take 4-6 cards) |
| 8 | (very abrupt) Sorry . . . (always followed by take 4-6 cards) |
| 9 | You know, I'm not Sorry at all . . . (always followed by take 7-9 cards) |
| 10 | Sorry, don't take this personally, but . . . (always followed by take 7-9 cards) |
| 11 | And now for something completely unfair . . . (always followed by take 7-9 cards) |
| 12 | Take 1 card |
| 13 | Take 2 cards |
| 14 | Take 3 cards |
| 15 | Take 4 cards |
| 16 | Take 5 cards |
| 17 | Take 6 cards |
| 18 | Take 7 cards |
| 19 | Take 8 cards |
| 20 | Take 9 cards |
| 21 | and . . . |
| 22 | you must . . . |
| 23 | Argh, my neck. I can't feel my legs. Wait, I don't have any legs. |
| 24 | Hey, watch the hairdo . . . bald is beautiful. |
| 25 | Oh! You did that soo gently . . . |
| 26 | take another two cards |
| 27 | I'm in a giving mood. EVERYBODY take one card. Sorry. |
| 28 | and give two of them to any other player |
| 29 | (big yawn) Sorry, er . . . are we still playing? |
| 30 | Ok, got to go. Sorry. Bye |
| 31 | I didn't want to do this |
| 32 | Mmmm, mmmm, mmm, mm, . . . sorry |
| 33 | Da, da-da, dee, dee. So, so Sorry . . . yeah |
| 34 | Hurry, hurry. |
| 35 | Come on |
| 36 | |
| 37 | The player with the next birthday goes first. Stop planning your next birthday party and get started. |
| 38 | The oldest player can go first. Hey, thought I'd give you a chance. |
| 39 | The youngest player can take the first turn. |
| 40 | Alright! Glad we're still playing, but can you pick up the pace a little? |
| 41 | Easy tiger. |
| 42 | Loser! |

*FIG. 6*

130

| 132 Instruction Number | 134 Phrases | 138 Number of Cards | 136 Speech |
|---|---|---|---|
| 1 | 8, 18 | 7 | (very abrupt) Sorry / Take 7 cards |
| 2 | 6, 17 | 6 | So Sorry / Take 6 cards |
| 3 | 25, 2, 13 | 2 | Oh! You did that soo gently / Sorry / Take 2 cards |
| 4 | 5,16 | 5 | (drawn out) Soorrry / Take 5 cards |
| 5 | 27 | 1 each | I'm in a giving mood. EVERYBODY take one card. Sorry. |
| 6 | 9, 18 | 7 | You know, I'm not Sorry at all / Take 7 cards |
| 7 | 7,17 | 6 | Sorry, this may sting a little / Take 6 cards |
| 8 | 5, 15 | 4 | (drawn out) Soorrry / Take 4 cards |
| 9 | 10, 18 | 7 | Sorry, don't take this personally, but / Take 7 cards |
| 10 | 6, 17, 28 | 6/2 | So Sorry / Take 6 cards / and give two of them to any other player |
| 11 | 3, 14 | 3 | I'm really sorry / Take 3 cards |
| 12 | 23, 11, 19 | 8 | Argh, my neck. I can't feel my legs. Wait, I don't have any legs. / And now for something completely unfair / Take 8 cards |
| 13 | 6, 17 | 6 | So Sorry / Take 6 cards |
| 14 | 4, 13, 21, 26 | 4 | I'm sorry I have to do this, but / Take 2 cards / and / take another two cards |
| 15 | 7, 15 | 4 | Sorry, this may sting a little / Take 4 cards |
| 16 | 5, 17 | 6 | (drawn out) Soorrry / Take 6 cards |
| 17 | 4, 13 | 2 | I'm sorry I have to do this, but / Take 2 cards |
| 18 | 8, 20, 28 | 9/2 | (very abrupt) Sorry / Take 9 cards / and give two of them to any other player |
| 19 | 5, 16 | 5 | (drawn out) Soorrry / Take 5 cards |
| 20 | 2, 14 | 3 | Sorry / Take 3 cards |
| 21 | 27 | 1 each | I'm in a giving mood. EVERYBODY take one card. Sorry. |
| 22 | 3, 12 | 1 | I'm really sorry / Take 1 card |
| 23 | 7, 16 | 5 | Sorry, this may sting a little / Take 5 cards |
| 24 | 5, 17 | 6 | (drawn out) Soorrry / Take 6 cards |
| 25 | 23, 8, 22, 17 | 6 | Argh, my neck. I can't feel my legs. Wait, I don't have any legs./ (very abrupt) Sorry / you must / Take 6 cards |
| 26 | 6, 15 | 4 | So Sorry / Take 4 cards |
| 27 | 9, 19 | 8 | You know, I'm not Sorry at all / Take 8 cards |
| 28 | 4, 14 | 3 | I'm sorry I have to do this, but / Take 3 cards |
| 29 | 7, 16 | 5 | Sorry, this may sting a little / Take 5 cards |
| 30 | 5, 15 | 4 | (drawn out) Soorrry / Take 4 cards |
| 31 | 25, 2, 12 | 1 | Oh! You did that soo gently / Sorry / Take 1 card |
| 32 | 3, 14 | 3 | I'm really sorry / Take 3 cards |
| 33 | 10, 18 | 7 | Sorry, don't take this personally, but / Take 7 cards |
| 34 | 27 | 1 each | I'm in a giving mood. EVERYBODY take one card. Sorry. |
| 35 | 6, 16 | 5 | So Sorry / Take 5 cards |
| 36 | 11, 20 | 9 | And now for something completely unfair / Take 9 cards |
| 37 | 4, 13 | 2 | I'm sorry I have to do this, but / Take 2 cards |
| 38 | 7, 16 | 5 | Sorry, this may sting a little / Take 5 cards |
| 39 | 24, 8, 19 | 8 | Hey, watch the hairdo . . . bald is beautiful. / (very abrupt) Sorry / Take 8 cards |
| 40 | 5, 15 | 4 | (drawn out) Soorrry / Take 4 cards |

*FIG. 7*

140

| 142 | 144 | 142 | 144 |
|---|---|---|---|
| Phrase Column Sequence Number | Phrase Column Identifier | Phrase Column Sequence Number | Phrase Column Identifier |
| 1 | B | 10 | B |
| 2 | A | 11 | C |
| 3 | C | 12 | B |
| 4 | B | 13 | C |
| 5 | C | 14 | B |
| 6 | B | 15 | B |
| 7 | A | 16 | A |
| 8 | B | 17 | B |
| 9 | C | 18 | C |

*FIG. 8*

150

| 154 | 152 | 156 | 154 | 152 | 156 | 154 | 152 | 156 |
|---|---|---|---|---|---|---|---|---|
| Phrase Column A | | | Phrase Column B | | | Phrase Column C | | |
| Delay | Phrase | | Delay | Phrase | | Delay | Phrase | |
| 5 | 35 | | 25 | 33 | | 45 | 32 | |
| 10 | 32 | | 10 | 32 | | 10 | 35 | |
| 15 | 32 | | 45 | 33 | | 25 | 33 | |
| 25 | 33 | | 10 | 34 | | 5 | 32 | |
| 45 | 34 | | 15 | 32 | | 15 | 34 | |
| 10 | 33 | | 5 | 35 | | 10 | 33 | |
| 10 | 29 | | 10 | 29 | | 10 | 29 | |
| 10 | 30 | | 10 | 30 | | 10 | 30 | |

*FIG. 9*

GAME HAVING AN ELECTRONIC INSTRUCTION UNIT

BACKGROUND

The patent is directed to a multi-player game, and more particularly to a multi-player game having an electronic instruction unit providing game instructions to the players during the course of game play.

Various games having electronic or electro-mechanical apparatus associated therewith have been previously described. For example, U.S. Pat. No. 4,572,513 to Evans discloses an educational game including a game board, at least one game piece and an audio recording. The game board has a serpentine path located on the top face thereof. The serpentine path is broken up into a series of connected squares. The game piece is designed such that it is moved along the path as the game is played. The audio recording contains a number of mathematical problems or other questions and the answers thereto. Each question or problem is separated from its answer by a pause of predetermined duration. Each time the player of the game answers a problem or a question correctly and within the time allowed, the player advances his/her game piece along the serpentine path. The number of squares on the path and the number of questions on the recording are equal so that if a player answers all of the questions correctly, his/her game piece exactly reaches the finish space.

U.S. Pat. No. 5,011,156 to LaChance, Jr. et al. discloses a game apparatus consisting essentially of a game board, cards, set of playing pieces for each player, a compact disc with multiple tracks set up in such a way that the playing pieces, or tokens, for each player will move around the board surface which may comprise a single or dual segmented path. Part or all of the segments contain one of the numbers in a two number selection code on the compact disc. Cards which are provided as part of the game apparatus will contain a second number of the two number selection code so that as playing the game, once both numbers are determined, the player will know which track to punch in on the compact disc control. The instructions on the compact disc track will determine further moves and actions and enhances the game play.

SUMMARY OF THE INVENTION

In one aspect, the invention is directed to a game for multiple players that may include a plurality of score-keeping surfaces, a plurality of groups of game pieces, each group corresponding to one of the score-keeping surfaces, an instruction unit that may have an input device and an output device, and a plurality of game cards that each may have game play indicia disposed thereon. The instruction unit may be actuated by a player at the input device, and the instruction unit may output an instruction at the output device in response to the actuation of the instruction unit by the player at the input device.

In another aspect, the present invention is directed to an instruction unit for a game. The instruction unit may include an input device, an output device, and a controller that may be operatively coupled to the input device and the output device. The controller may be programmed to store a plurality of game instructions for the game, to detect the actuation of the input device by a player of the game, to retrieve one of the plurality of game instructions in response to detecting the actuation of the input device, and to cause the output device to output the retrieved game instruction.

In a further aspect, the invention is directed to a method of game play for a game for a plurality of participants. The method may include providing an instruction unit and a deck of game cards, wherein each game card may have game indicia disposed thereon, distributing a plurality of the game cards to each participant of the game, and each player in turn comparing the game indicia of the game cards distributed to the player to the game indicia of a top card of a discard pile of the plurality of cards. The method may further include discarding at least one of the game cards distributed to the player onto the discard pile in response to the player determining that the game indicia of the player's game cards corresponds to the game indicia of the top card of the discard pile such that the cards may be played on the top card, and actuating the instruction unit to output a game instruction in response to the player determining that the game indicia of the player's game cards does not correspond to the game indicia of the top card of the discard pile such that none of the game cards of the player may be played on the top card. Still further, the method may include at least one player selecting at least one additional game card from the deck of game cards in response to the game instruction output by the instruction unit.

In an additional aspect, the invention is directed to a method of game play for a game for a plurality of players the may include distributing a plurality of game cards to each player of the game, sequential players discarding game cards onto a discard pile when possible in accordance with game rules, sequential players actuating an instruction unit to output a game instruction when in accordance with game rules it is not possible to discard game cards onto the discard pile, and following the game instruction output by the instruction unit. In yet another aspect, the invention is directed to a method of game play for a game for a plurality of players the may include distributing a plurality of game cards to each player of the game, sequential players discarding game cards onto a discard pile or actuating an instruction unit to output a game instruction as determined by game rules, and following the game instruction output by the instruction unit.

Additional aspects of the invention are defined by the claims of this patent.

BRIEF DESCRIPTION OF THE DRAWINGS

FIG. 2A is a front view of a numeric card for the game of FIG. 1;

FIG. 2B is a front view of a reverse card for the game of FIG. 1;

FIG. 2C is a front view of a extra turn card for the game of FIG. 1;

FIG. 2D is a front view of a trade hands card for the game of FIG. 1;

FIG. 2E is a front view of a sorry card for the game of FIG. 1;

FIG. 2F is a front view of a slide card for the game of FIG. 1;

FIG. 2G is a front view of a safety zone card for the game of FIG. 1;

FIG. 6 is a chart of phrase numbers and corresponding phrases that may be broadcast by the electronic instruction unit during the game;

FIG. 7 is a chart of instruction numbers and corresponding phrases that may be used by the electronic instruction unit during the routines of FIGS. 6A and 6B;

FIG. 8 is a chart of random phrase column numbers and corresponding random phrase columns that may be used by the electronic instruction unit during the wait routine of FIG. 6C; and FIG. 9 is a chart of random phrase columns and corresponding delay periods and phrase numbers that may be used by the electronic instruction unit during the wait routine of FIG. 6C.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
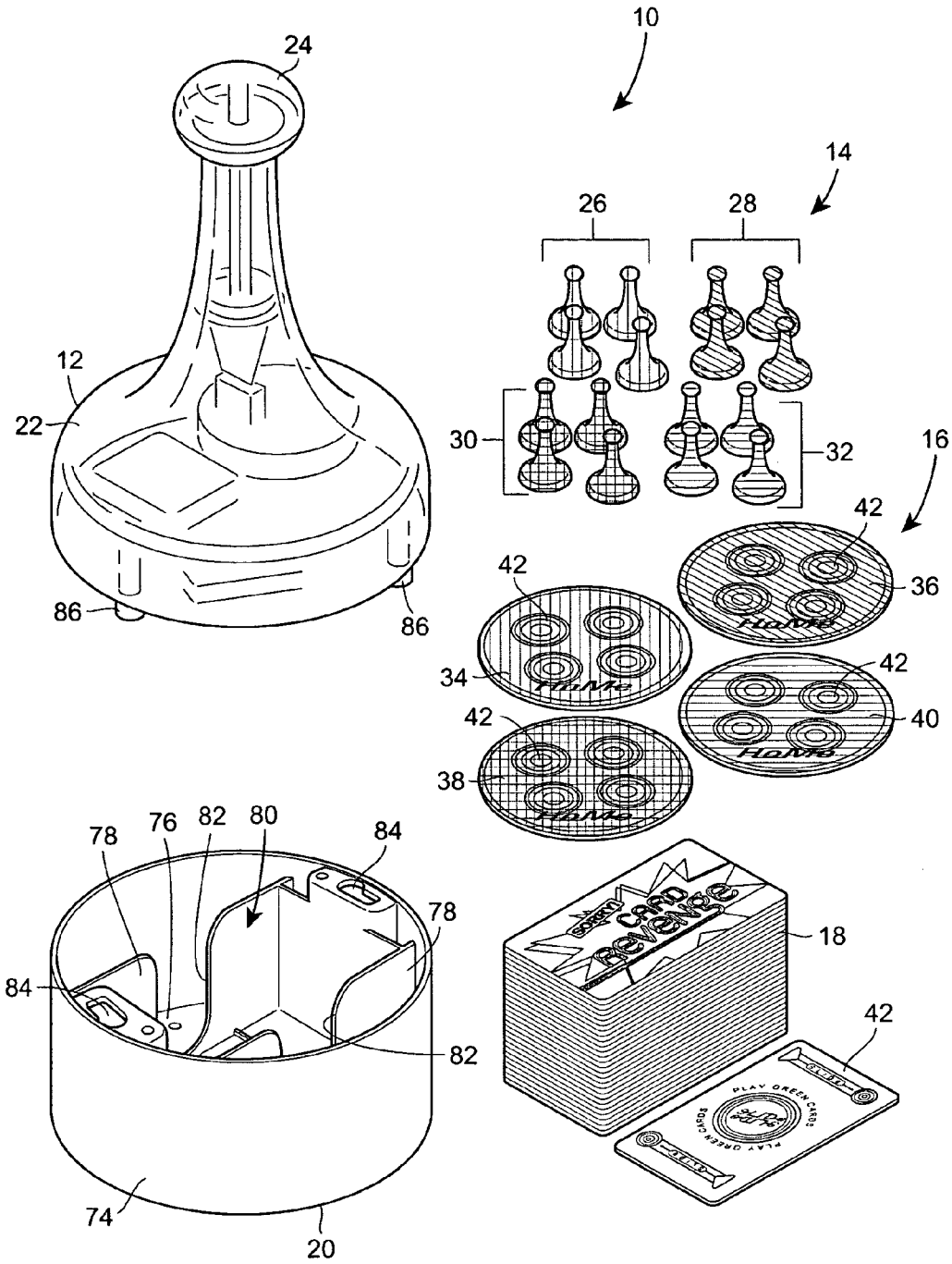
FIG. 1 is a perspective view of an embodiment of game having an electronic instruction unit in accordance with the invention.

FIG. 1 illustrates one possible embodiment of a game 10 for a plurality of players having an electronic instruction unit 12 in accordance with the invention. The embodiment of the game 10 illustrated in FIG. 1 is based on the Sorry! game wherein each player has a plurality of game pieces that must be moved around a game board from a starting position to a home position. In this embodiment of the game, each player may have a plurality of game pieces that must be moved onto the player's game board in order for the player to win the game. Each player is dealt a plurality of cards from a deck of game cards, and must play cards onto a discard pile according to the rules of the game and the indicia on the cards in an effort to play all the cards in the player's hand. During the course of a player's turn, when the player is unable to play a card onto the discard pile, the player may be required to actuate the instruction unit 12 to receive an instruction regarding the selection of additional cards from the available cards by the player or by other players. Once a player plays all the cards in the player's hand, the player may move one of the player's game pieces onto the player's game board, and then select additional cards from the deck. The sequence may continue until one player has moved all of the player's game pieces onto the player's game board.

This embodiment and the drawing figures herein are exemplary only, and are not intended to limit the scope of the claims to this particular embodiment. Other configurations of the game 10 are contemplated having, for example, different configurations of the game board or boards, or other score-keeping surfaces, different electronic instruction units, different game pieces, different cards and indicia, different game play and instruction sequences and game rules, and other variations that are within the scope of the claims defining the invention. Furthermore, it is contemplated that the game 10, in addition to the electronic instruction unit 12, may be implemented partially or entirely through electronic and/or graphic means such that the game layout, game pieces, game cards and audio portions of the game are presented via video or audio technology.

Referring now to FIG. 1, the game 10 may include the electronic instruction unit 12, a plurality of game pieces 14, a plurality of game boards 16, a deck of game cards 18, and a storage base 20. The electronic instruction unit 12 may be any electrical unit capable of receiving an input from a player, and of broadcasting or displaying an instruction to the players in response to receiving the input from the player. In the illustrated embodiment, the electronic instruction unit 12 may be in the form of a large pawn, and may have a housing 22 enclosing the internal components of the instruction unit 12, and which may be fully or partially transparent such that the internal components are visible through the wall of the housing 22, and an activation button or knob 24 that may be engaged by a player to provide the input to the instruction unit 12. The components and operation of the instruction unit 12, and its use during the game 10, will be discussed more fully hereinafter.

The game pieces 14 may be configured in any manner consistent with the theme of the game 10, and groups of the game pieces 14 may have distinct characteristics such that the game pieces 14 within each group may be identified as belonging to the same group. For example, the game pieces 14 as illustrated may be in the form of small colored pawns that may be clearly identified as groups of red pawns 26, green pawns 28, yellow pawns 30 and blue pawns 32. The game 10 may include any number of game pieces 14, and any number of groups of game pieces as may be necessary for the number of players and the game play of the game 10. Further, the game pieces 14 may have any other desired shape and/or indicia disposed thereon as desired for the theme of the game, and for distinguishing the game pieces 14 into separate groups for use by the players of the game 10.

Similar to the game pieces 14, the score-keeping surfaces or game boards 16 may be configured in any manner consistent with the theme of the game 10 and the configuration of the game pieces 14 to provide score-keeping surfaces for the players of the game 10. As illustrated, the game 10 may include one game board 16 corresponding to each of the groups of game pieces 14. In this example, the game 10 may include a red game board 34, a green game board 36, a yellow game board 38 and a blue game board 40 corresponding to the groups of pawns 26, 28, 30, 32, respectively. The game boards 34, 36, 38, 40 may further include indicia 42 disposed thereon corresponding to each of the game pieces 14 of the corresponding group, and consistent with and enhancing the theme of the game 10. During the game play of the game 10, each player may have one of the game boards 16 and the corresponding group of the game pieces 14. While the game 10 is illustrated as having a game board 16 for each player, it is contemplated that the game 10 may be implemented with a single game board 16 having indicia disposed thereon corresponding to each of the groups of game pieces 14 for use by the players.

The deck of cards 18 may include a plurality of cards 42 having indicia 44 disposed thereon that, along with the rules for the game 10, dictate the way in which the cards 42 may be played by the players during the course of the game 10. As previously discussed, each player may be dealt a plurality of cards 42 from the deck 18 at the start of the game 10. During a player's turn, the player may be able to lay down one or more of the cards 42 in the player's hand on a discard pile depending on the indicia 44 on the top card 42 on the discard pile, and the indicia 44 on the cards 42 in the player's hand. The game 10 may include a plurality of different types of cards 42, each having unique game play characteristics when played alone or in combination with other types of cards 42.

FIGS. 2A-2G illustrate different types of cards 42 that may be use in the game play for the game 10. FIG. 2A illustrates a numeric card 46 having a number indicia 48 disposed thereon. The game 10 may have a plurality of numeric cards 46 each having a number indicia 48 selected from a range of available numbers for the game, such as the sequence of numbers from one to twelve, and the available numbers may appear on multiple numeric cards 46. In addition to the number indicia 48, the numeric cards 46 may be colored such that the numeric cards 46 may be divided into groups by color. For example, each numeric card 46 may be either red, green, yellow or blue, and each group of colored cards may include two cards each having one of the numbers from the sequence from one to twelve.

During a player's turn of the game 10, the game rules may allow the player may play one or more numeric cards 46 based on the color and the number of the top card 42 on the discard pile and of the numeric cards 46 in the player's hand. In the game rules of one alternative game play involving numeric cards 46, the player may lay down a numeric card 46 having the same color as the top card 42 on the discard pile. For example, if the top card 42 on the discard pile is a blue nine, the player may lay down any other blue card 46 on the pile, such as a blue six. Depending on the specific rules, the player may be limited to laying down only one card 46 having a matching color, or all of the player's cards 46 having a matching color. In the game rules for another alternative game play, the player may be permitted to lay down one or more cards 46 of any color in an ascending or descending sequence, starting with the next number greater than or less than the card 42 on top of the discard pile. For example, if the top card 42 is a yellow six, a player may lay down numeric cards 46 of any color in the ascending sequence starting with seven or in the descending sequence starting with five. Once the player lays down all the cards 46 of the sequence, the player's turn may be over. Depending on the rules of the game 10, the sequences may wrap around the number range for the cards 46 such that, for example, the number one may follow the number twelve in the ascending sequence and vice versa.

FIGS. 2B-2D illustrate numeric cards 50, 52, 54 that may include, in addition to the number indicia 48 and color, special rules indicia for the game play when the numeric cards 50, 52, 54 are played by the player. Referring to FIG. 2B, a reverse card 56 having reverse indicia 56 thereon may cause the players to reverse the order of play when the reverse card 56 is the last card played by a player. As a result, in games involving more than two players, if the order of play was moving to the player on the left, the order may reverse and move to the player on the right after a reverse card 56 is played on the pile. FIG. 2C illustrates an extra turn card 52 having extra turn indicia 58 thereon that may allow a player to take another turn when the extra turn card 52 is played, if the player chooses. Finally, FIG. 2D illustrates a trade card 54 having trade indicia 60 disposed thereon that may allow a player to trade their hand for any other player's hand if the player so desires. While the cards 50, 52, 54 have special rules associated with them, the cards 50, 52, 54 may be playable by the players subject to the normal rules for playing other numeric cards 46 as described above. Moreover, the special rules cards 50, 52, 54 are merely exemplary, and other special rules may be implemented for the game 10 to implement a desired game play.

In addition to the numeric cards 46, 50, 52, 54 described above, the game 10 may further include one or more types of wild cards having distinct rules of game play. In the illustrated embodiment, wild cards may be played at any time regardless of the card 42 on the top of the discard pile. However, the wild cards may be implemented with restrictions regarding the types of cards 42 on which the wild cards may be played. FIG. 2E illustrates one type of wild card in the form of a sorry card 62 having sorry indicia 64 thereon. The sorry card 62 may be played on top of any other card 42, and the player may select another player to activate the instruction unit 12 to receive an instruction as described more fully below. Once the sorry card 62 is played, the player's turn may be over, and the next player may play any card in their hand on top of the pile. FIG. 2F illustrates a slide card 66 having slide indicia 68 thereon. The game 10 may include a plurality of slide cards 66, with each slide card 66 having a color corresponding to one of the colors of the numeric cards 46, 50, 52, 54. A player may be permitted to play a slide card 66 on any other card 42 on the top of the pile, and the slide card 66 may permit the player to lay down all of the cards 42 in the player's hand matching the color of the slide card 66. Consequently, when a player plays a red slide card 66, the player may also lay down all of the red numeric cards 46, 50, 52, 54 in the player's hand. After one player plays a slide card 66, the next player may be able to play one or more cards of the same color, or another wild card. Finally, FIG. 2G illustrates a safety zone card 70 having safety zone indicia 72 thereon. As with the other wild cards, the safety zone cards 70 may be played on any other card 42 on top of the pile. Once the safety zone card 70 is played, the player's turn may be over, and the player may not be permitted to play any other cards. As with the special rules cards 50, 52, 54, the wild cards 62, 66, 70 are merely exemplary, and other wild cards may be implemented for the game 10 to implement a desired game play.

Returning to FIG. 1, the base 20 of the game 10 may be configured as an open-ended hollow cylinder having a cylindrical outer wall 74 and a bottom 76. The outer wall 74 may be dimensioned to correspond to the outer circumference of the instruction unit 12, and to provide sufficient space to receive the game pieces 14, game boards 16 and deck of cards 18. The base 20 may further include inner walls 78 defining a card storage area 80 adapted to receive the stacked deck of cards 18 and maintaining the deck of cards 18 in substantial vertical alignment with the game pieces 14 being disposed on the opposite sides of the inner walls 78 from the card storage area 80. To facilitate removal of the deck of cards 18, the inner walls 78 may include cutout portions 82 allowing a player to reach into the base 20, grasp the deck of cards 18 from the sides, and lift the deck of cards 18 out of the base 20. In order to secure the instruction unit 12 to the base 20, the base 20 may further include inner surfaces defining holes 84 adapted to receive feet 86 on the bottom of the instruction unit 12 and, once the feet 86 are received and the instruction unit 12 is turned, to retentively engage the feet 86 to demountably attach the instruction unit 12 to the base 20.

At the start of the game 10, the instruction unit 12 may be placed in the center of the playing area, and each player may select a game board 16 and the corresponding group of game pieces 14. The game board 16 may be placed in front of the player with the game pieces 14 beside the game board 16. The deck of cards 18 may be shuffled, and an equal number of the cards 42 may be dealt out to each player. The remaining cards 42 in the deck of cards 18 may be placed face down in the middle of the playing area, and the top card 42 may be turned face up and placed beside the deck to start the discard pile. The game may begin by turning on the instruction unit 12 and actuating the unit 12 in a manner described more fully below to determine which player goes first. On each player's turn, the player may either play one or more cards 42 on the discard pile in the manner described above if the player can player a card 42, or the player can activate the instruction unit 12 to receive an instruction if the player cannot play a card based on the card 42 on the discard pile and the cards 42 in the player's hand.

Play may proceed with each player in turn either laying down cards 42 on the discard pile or activating the instruction unit 12 as dictated by the cards 42 in the player's hand. If a player plays the last card 42 in the player's hand, the player may be entitled to move one of the game pieces 14 onto the player's game board 16. After moving the game piece 14 onto the game board 16, the player may draw five more cards 42 from the pile, and the game 10 may continue with the next player's turn. The game 10 may continue in this manner until one of the player's moves their last game piece 14 onto the game board 16.

Figure 3:
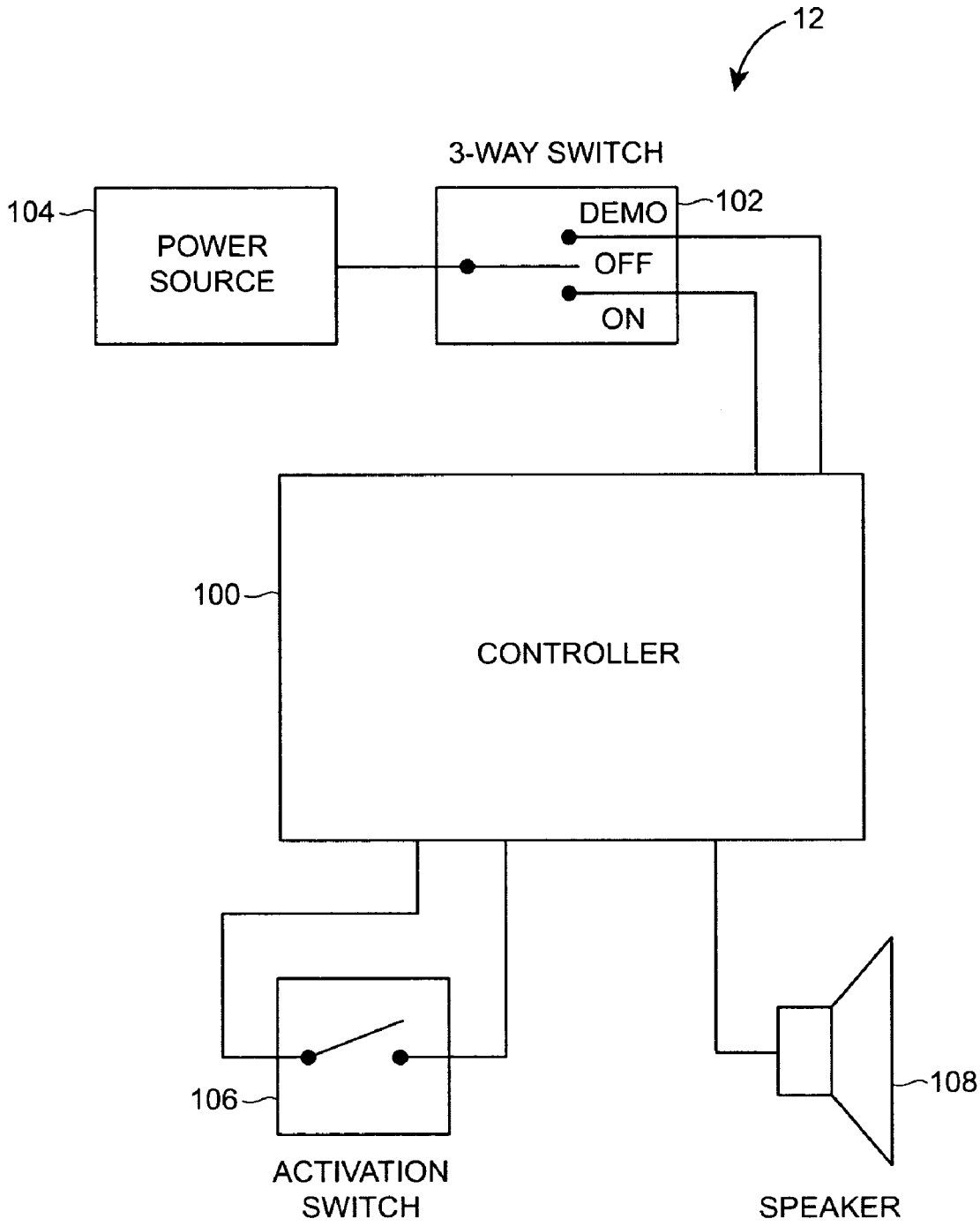
FIG. 3 is a block diagram of the electronic components of the electronic instruction unit for the game of FIG. 1.
Figure 4:
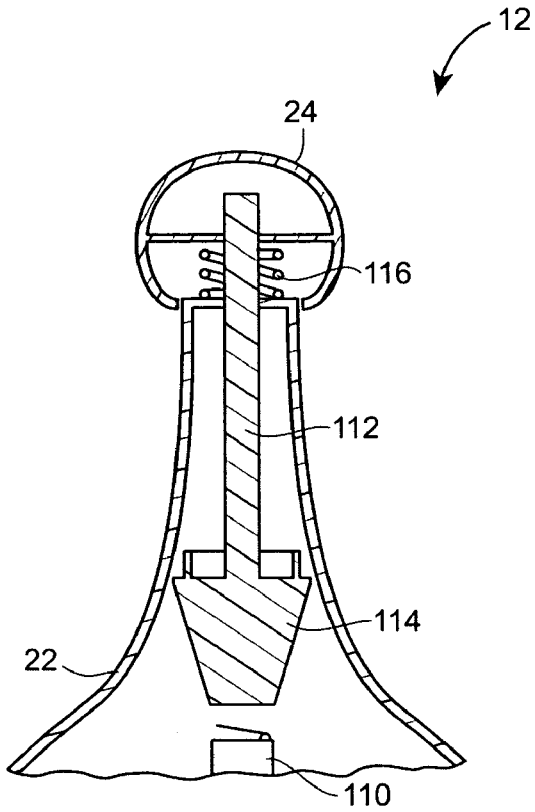
FIG. 4 is a cross-sectional view of the upper portion of the electronic instruction unit for the game of FIG. 1 in a normal position.

The structure of the instruction unit 12 will now be discussed with reference to FIGS. 3 and 4. FIG. 3 is a block diagram of a number of components that may be incorporated in the instruction unit 12. Referring to FIG. 3, the instruction unit 12 may include a controller 100 containing the game logic and sound generation data implemented via circuitry contained on a conventional printed circuit board, with the game execution logic and sound generation data being stored directly on the printed circuit board. It should be appreciated that although the controller 100 may be implemented on a printed circuit board, more complex implementations of the game 10 may be implemented wherein the controller 100 may comprise, among other components, a program memory, a microcontroller or microprocessor (MP), a random-access memory (RAM), read-only memory (ROM) and an input/output (I/O) circuit, all of which may be interconnected. It should be appreciated that the controller 100 may include multiple microprocessors. Similarly, the memory of the controller 100 may include multiple RAMs and multiple program memories, depending on the complexity and requirements of a specific implementation. It should also be appreciated that the I/O circuit may include a number of different types of I/O circuits, such as sound generation circuits, video generation circuits, odor generation circuitry, and the like. The RAM(s), ROM(s) and program memories may be implemented as semiconductor memories, magnetically readable memories, and/or optically readable memories, for example.

FIG. 3 illustrates that the controller 100 may be operatively coupled to a three-way mode switch 102, an activation switch 106, and a speaker 108, each of those components being so coupled via a respective direct line or conductor. In addition, the three-way mode switch 102 may be operatively coupled to a power supply 104. Different connection schemes could be used. The three-way mode switch 102 may be coupled to the controller 100 such that the instruction unit 12 may operate in a demonstration mode when the switch 102 is set to the "DEMO" position, may operate in a game play mode when the switch is set to the "ON" position, and may be powered off when the switch 102 is set to the "OFF" position. The operation of the instruction unit 12 in the demonstration and game play modes is discussed more fully below.

When the three-way mode switch 102 is set to either the "DEMO" position or the "ON" position, the controller 100 may be connected to the power source 104, which may be batteries inserted into a battery compartment of the instruction unit 12, an external battery, a power cord connected to a wall outlet, or any other appropriate source of electrical power, such that the power source 104 may provide power to the controller 100, circuitry and other components 106, 108. Input signals produced by the activation switch 106 are output to the controller 100 for processing by the game execution logic in both the demonstration and the game play modes. Depending on the processing performed, the circuitry of the controller 100 generates and outputs sound generation signals to the speaker 108, wherein the speaker 108 translates the output signals into sounds that are broadcast through holes in the housing 22 of the instruction unit 12 such that the sounds may be heard by the participants of the game 10. The general and specific technologies relating to electronic sound generation circuitry, and the software required to run such devices, are well known to those skilled in the electronic and software arts, and therefore the specific details of the digital processing and memory portions of such circuitry, and the specific details of any software required for this specific application will not be described further herein.

While the output device or mechanism for the instruction unit 12 is illustrated herein as the speaker 108 which may broadcast game instructions that may be audibly perceptible to the players, those skilled in the art will understand that the instruction unit 12 may be implemented with an desired output device capable of conveying the game instructions in any manner that may be perceptible to the players. For example, in an alternative embodiment, the output device for the instruction unit 12 may be a visual display for the game instructions that may be viewable by the players to convey the game instructions. As a further alternative, the output device may be a printer to which the controller 100 may output signals causing the printer to print and dispense game instructions when a player presses the knob 24. Other output devices or mechanisms may be implemented in the instruction unit 12 as desired, and are contemplated by the inventor as having use with the game 10 and instruction unit 12 of the present invention.

Figure 5:
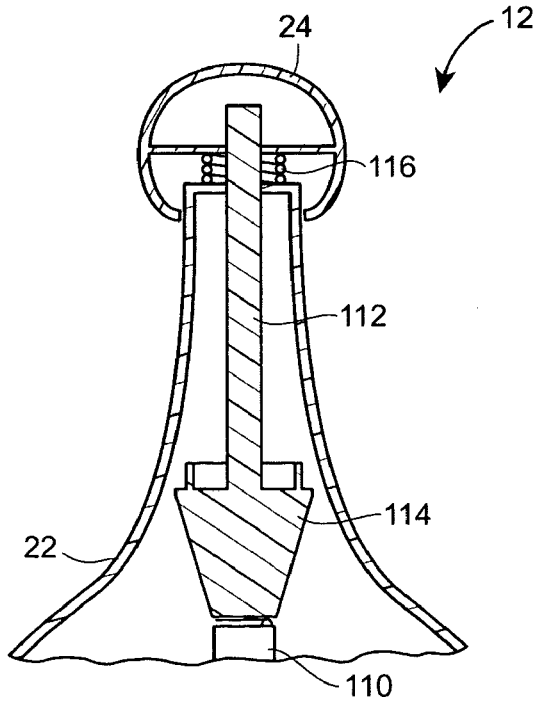
FIG. 5 is a cross-sectional view of the upper portion of the electronic instruction unit for the game of FIG. 1 in an activation position.

As previously discussed, the controller 100 receives input signals from the activation switch 102, and the input signals cause the controller 100 to process the game execution logic in the demonstration and game play modes. FIGS. 4 and 5 illustrate one embodiment of the instruction unit 12 wherein the activation switch 102 may be a micro switch 110 disposed within the housing 22 of the instruction unit 12 and configured to be actuated in response to displacement of the knob 24 on the top of the instruction unit 12. As shown in FIG. 4, the knob 24 may be slidably disposed on the top of the instruction unit 12, and may have a downwardly extending arm 112 and a finger 114 disposed within the housing 22. The knob 24 may be biased toward a normal position by a spring 116 disposed between and engaging an inner surface of the knob 24 and a top surface of the housing 22. When the knob 24 is in the normal position of FIG. 4, the finger 114 may be disengaged from the micro switch 110 such that the micro switch 110 is not actuated and does not transmit input signals to the controller 100.

During the course of the game 10 when a player may not be able to lay down a card 42 on the discard pile, or during the demonstration mode, the player may actuate the micro switch 110 and, correspondingly, activate the instruction unit 12 by depressing the knob 24 downwardly against the biasing force of the spring 116. When the knob 24 is depressed, the arm 112 and finger 114 move downwardly, with the finger 114 engaging and actuating the micro switch 110 as shown in FIG. 5. With the micro switch 110 actuated, input signals are transmitted to the controller 100 to thereby cause the controller 100 to process the demonstration or game execution logic stored thereon. When the downward force is removed from the knob 24, the biasing force of the spring 116 may cause the knob 24, arm 112 and finger 114 to move upwardly toward the normal position of FIG. 4 and disengage from the micro switch 110.

While the micro switch 110 is discussed herein as transmitting an input signal to the controller 100 indicating the depression of the micro switch 110 in response to the movement of the knob 24, those skilled in the art will understand that the micro switch 110 may be configured to transmit a continuous input signal when the micro switch 110 does not detect the movement of the knob 24, and discontinue the input signal when the knob 24 is depressed and the micro switch 110 is actuated, thereby informing the controller 100 of the depression of the knob 24 by the absence of input signals from the micro switch 110. Further, while the activation switch 106 is illustrated herein as micro switch 110, the activation switch 106 may be implemented via any type of switch or other input mechanism that may detect input at the instruction unit 12 by a player. For example, the activation switch 106 may be an optical sensor configured to transmit input signals to the controller 100 indicating the proximity of the player to the instruction unit 12 when the player covers the optical sensor. As a further alternative, the actuation switch 106 may be implemented via a switch that detects the pressure from the player on the activation switch 106, either directly of via some other mechanism capable of applying pressure to the activation switch 106 in response to an input by the player. Those skilled in the art will understand that other mechanisms for detecting an input by the player and causing an input signal or otherwise activating the controller 100 to process the game execution logic may be implemented in an instruction unit 100, and are contemplated as having use with the present invention.

As previously discussed, the instruction unit 12 may operate in either a demonstration mode or a game play mode. In order to activate the instruction unit in the demonstration mode, the three-way switch 102 may be moved the "DEMO" position, thereby causing the controller 100 to execute the demonstration mode logic programmed therein. While in the demonstration mode, the controller 100 may be programmed to transmit one of a plurality of available sound generation signals to the speaker 108 in response to detecting the activation of the activation switch 106. The controller 100 may store sound generation signals corresponding to a plurality of phrases and other sounds that may be broadcast from the instruction unit 12 in the demonstration and game play modes. FIG. 6 is a table 120 containing a plurality of phrases 122 and corresponding phrase identification numbers 124 that may be stored at the controller 100 in the form of sound generation signals for use by the instruction unit 12. The controller 100 may cause the sound generation signals for one or more of the phrases 122 to be output to the speaker 108 in response to instructions within the demonstration mode or game play mode logic to output the sound generation signals for the corresponding one or more of the phrase identification numbers 124. For example, during the demonstration mode, the logic programmed into the controller 100 may cause the controller 100 to randomly or sequentially select one of the first three phrases (0.1, 0.2 or 0.3) of table 120 in response to the activation of the activation switch 106. Once the phrase is selected, the controller 100 may then output the corresponding sound generation signals to the speaker 108 for broadcasting to the person pressing the knob 24 to induce the person to purchase the game 10.

Figure 6A:
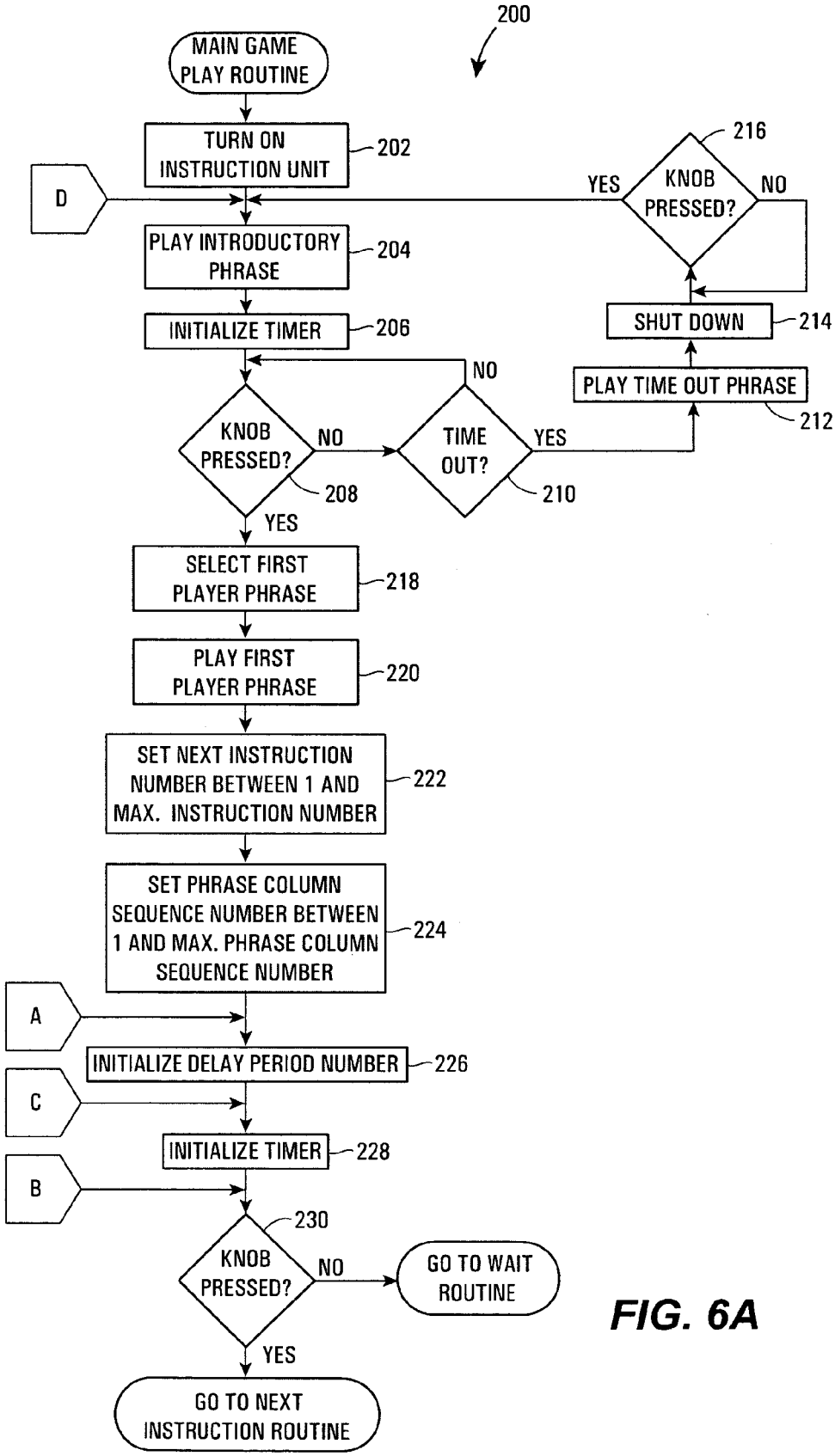
FIG. 6A is a flowchart of an embodiment of a main game play routine that may be performed by the electronic instruction unit during the game.

FIG. 6A is a flowchart of a main game play routine 200 that may be stored in the memory of the controller 100 and executed when the instruction unit 12 is in the game play mode. The main game play routine 200 may begin operation at block 202 wherein the three-way switch 102 of the instruction unit 12 may be moved to the "ON" position by a player. After the three-way switch 102 is set to the "ON" position, control may pass to a block 204 wherein the controller 100 may output the sound generation signals for an introductory phrase, such as phrase number 1 of table 120, to the speaker 108. After broadcasting the introductory phrase, the controller 100 may initialize a timer at a block 206 and evaluate at a block 208 whether the knob 24 of the instruction unit 12 has been pressed by a player and, correspondingly, the activation switch 106 has been actuated.

If the knob 24 is not pressed, control may pass to a block 210 wherein the controller 100 may determine whether a predetermined wait time has elapsed on the timer. If the wait time has not elapsed, control may return to the block 208 for the controller 100 to wait for a player to press the knob 24. If the wait time has elapsed at the block 210, control may pass to a block 212 wherein the controller 100 may output sound generation signals to the speaker 108 corresponding to a time out phrase, such as phrase number 30 of table 120. After playing the time out phrase at the block 212, the controller 100 may cause the instruction unit 12 to enter a shut down mode at a block 214 and further wait for a player to press the knob 24 and actuate the activation switch 106. As long as the controller 100 does not detect actuation of the activation switch 106 at a block 216, the controller 100 may remain in the shut down mode. When the controller 100 finally detects the actuation of the activation switch 106 in response to a player pressing the knob 24, control may pass back to the block 204 wherein the introductory phrase may be replayed and to the block 206 wherein the timer may be reinitialized.

When the controller 100 detects the actuation of the activation switch 106 at the block 208 within the predetermined wait time, control may pass to a block 218 wherein the controller 100 may randomly select a first player phrase from a plurality of available phrases, and output the corresponding sound generation signals to the speaker 108 at a block 220 to broadcast the selected first player phrase to the players. The first player phrases may identify the first player to attempt to lay down a card 42 on the discard pile by criteria such as the player having the next birthday (phrase number 37 of table 120), the oldest player (phrase number 38), the youngest player (phrase number 39), or by any other desired criteria. While the phrase are shown as being randomly selected, the controller 100 may alternatively select the first player phrases sequentially, or by any other method desired when the game 10 is configured.

In addition to selecting and playing the first player phrase after the knob 24 is pressed, the controller 100 may initialize the instruction unit 12 in preparation for broadcasting instructions to the players when the knob 24 is subsequently pressed during the game 10. At a block 222, the controller 100 may randomly select the next instruction number to be broadcast by the instruction unit 12 in response to a player pressing the knob 24 and save the number at a stored next instruction number. The controller 100 may store a plurality of instruction numbers, each corresponding to an instruction phrase that may be broadcast by the instruction unit 12. FIG. 7 is a table 130 containing a plurality of instruction numbers 132 and corresponding phrases numbers 134 that, when broadcast together as speech 136, make up the various instructions for the players while playing the game 10. Each instruction may consist of one or more of the phrases 122 from table 120 of FIG. 6 that may be broadcast together, in particular combinations of phrase numbers 2-28. For example, instruction number 1 consists of phrase number 8 ("Sorry") followed by phrase number 18 ("Take 7 cards"). Each instruction number 132 may have a corresponding number of cards 138 that the players may be required to draw from the deck 18 when the corresponding instruction is broadcast by the instruction unit 12. The controller 100 may store the instruction numbers 132 and corresponding phrase numbers 134 so that the controller 100 may output the appropriate sound generation signals to the speaker 108 when the knob 24 is pressed by a player as discussed more fully below.

In addition to initializing the stored next instruction number, the controller 100 may also initialize a phrase column sequence number that may be used to determine which of a plurality of available sets of delay phrases may be broadcast during a period in which the instruction unit 12 awaits player input. At a block 224, the controller 100 may randomly select a number between one and the maximum phrase column sequence number, and set the stored phrase column sequence number to the selected number. FIG. 8 is a table 140 of phrase column sequence numbers 142 and corresponding phrase column identifiers 144 that may be stored by the controller 100. Each phrase column identifier 144 may correspond to an entry in a phrase column table 150, such as the table 150 shown in FIG. 9. Each phrase column 152 may include a plurality of delay periods 154 and corresponding delay phrases 156 that may be sequentially broadcast by the instruction unit 12 as the instruction unit 12 awaits input from a player to activate the instruction unit 12. The selection of one of the phrase column 152 based on the phrase column sequence number 142 and the broadcasting of the delay phrases 156 in the phrase column will be discussed more fully below.

Returning to FIG. 6A, once the next instruction number 132 is initialized at the block 222 and the stored phrase column sequence number is initialized at the block 224, control may pass to a block 226 wherein the controller 100 may initially set the delay period number 154 equal to one, and to a block 228 wherein the controller 100 may initialize the timer in a similar manner as described with respect to the block 206. Once the controller 100 initializes the instruction unit 12, control may pass to a block 230 wherein the controller 100 may evaluate whether the knob 24 of the instruction unit 12 has been pressed by a player and, correspondingly, the activation switch 106 has been actuated. If the controller 100 determines that the knob 24 has been pressed at the block 230, control may pass to a play next instruction routine 250 of FIG. 6B. If the controller 100 does not detect the actuation of the activation switch 106 at the block 230, control may pass to a wait routine 270 of FIG. 6C.

Figure 6B:
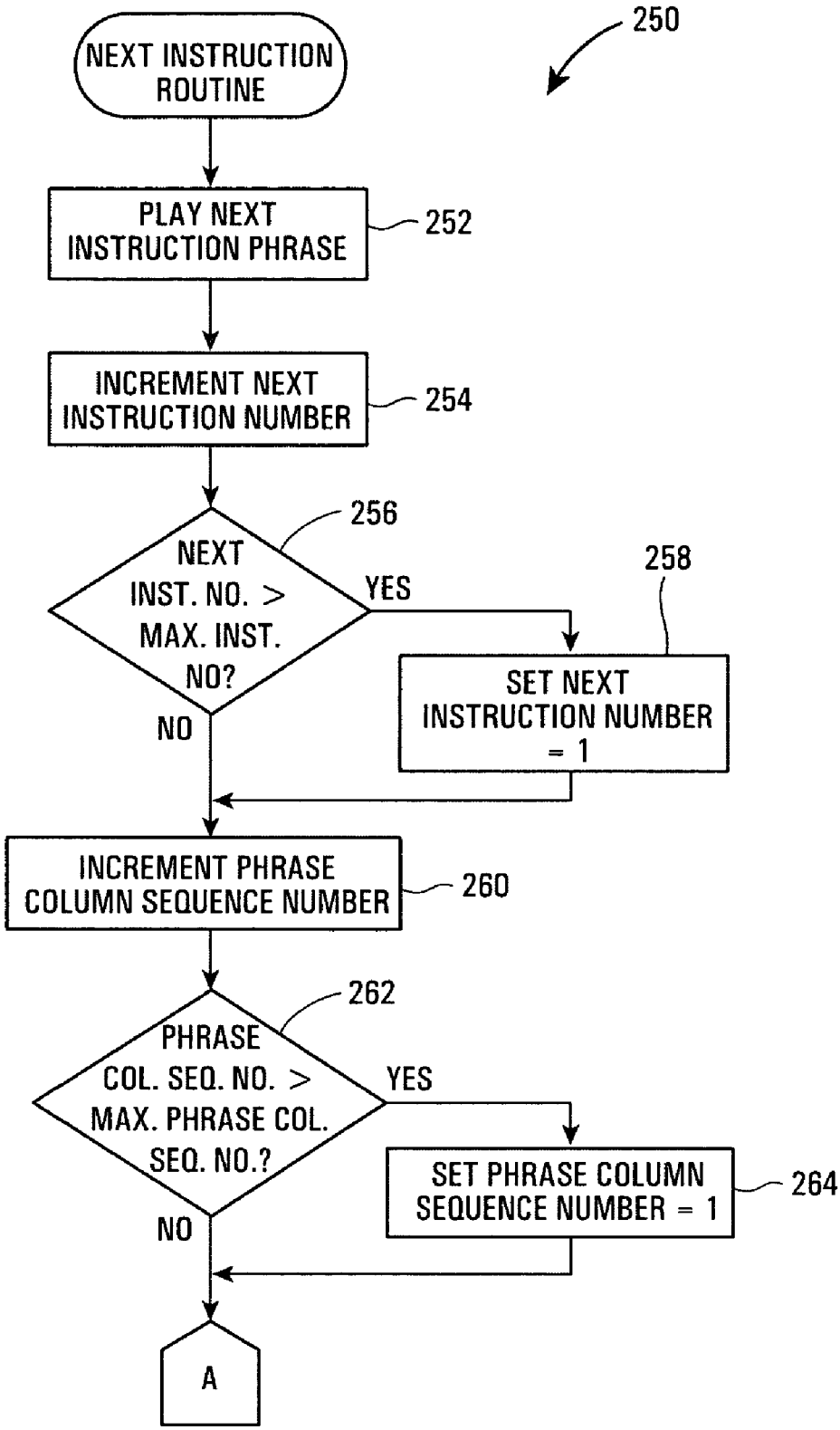
FIG. 6B is a flowchart of an embodiment of a play next instruction routine that may be performed by the electronic instruction unit during the game.

Referring to FIG. 6B, the play next instruction routine 250 may be executed by the controller 100 when the controller 100 detects the actuation of the activation switch 106 at the block 230 within the predetermined wait time for the phrase column 152 corresponding to the stored phrase column sequence number. The play next instruction routine 250 may begin at a block 252 wherein the controller 100 causes the next instruction number to be broadcast by the instruction unit 12. The controller 100 may use the stored next instruction number to look up the corresponding phrase number or numbers 134 in the table 130, and then output the corresponding sound generation signals to the speaker 108 for broadcasting. For example, if the current value of the stored next instruction number is twenty-six, the controller 100 may find the corresponding phrase numbers 134 (6 and 15) in the table 130, and then output the sound generation signals for phrase number 6 ("So Sorry") to the speaker 108, followed by the sound generation signals for phrase number 15 ("Take 4 cards"). Upon hearing the instructions, the player pressing the knob 24 may draw four cards 42 from the top of the deck of cards 18.

After the next instruction is broadcast to the players at the block 252, the controller 100 may ready the instruction unit 24 for broadcasting the next instruction to the players. Control may pass to a block 254 wherein the controller 100 may add one to the stored next instruction number. Because a limited number of instructions may be stored, and because the controller 100 cycles through the available instruction sequentially in this embodiment, it may be necessary for the controller 100 to ensure that the stored next instruction number remains within the range of available instruction numbers. Consequently, control may pass to a block 256 wherein the controller 100 may compare the stored next instruction number to the maximum instruction number. If the controller 100 determines that the stored next instruction number is greater than the maximum instruction number, then control may pass to a block 258 wherein the controller 100 may set the stored next instruction number equal to one so that the controller 100 may begin cycling through the available instructions from the beginning.

After the controller 100 resets the stored next instruction number to one at the block 258, or determines that the stored next instruction number is not greater than the maximum instruction number at the block 256, control may pass to a block 260 wherein the controller 100 may increment the stored phrase column sequence number in a similar manner so that a new sequence of delay phrases may be broadcast while waiting for another player to press the knob 24. As with the next instruction number 132, the stored phrase column sequence number should remain within the range of phrase column sequence numbers. Consequently, control may pass to a block 262 wherein the controller 100 may compare the stored phrase column sequence number to the maximum phrase column sequence number. If the controller 100 determines that the stored phrase column sequence number is greater than the maximum phrase column sequence number, then control may pass to a block 264 wherein the controller 100 may set the stored phrase column sequence number equal to one so that the set of delay phrases 156 of the phrase column 152 corresponding to the next phrase column sequence number 142 may be broadcast to the players. After the controller 100 resets the stored phrase column sequence number to one at the block 264, or determines that the stored phrase column sequence number is not greater than the maximum phrase column sequence number at the block 262, control may return to the game player routine 200 of FIG. 6A at the block 226 and wait for another player to press the knob 24 of the instruction unit 12.

Figure 6C:
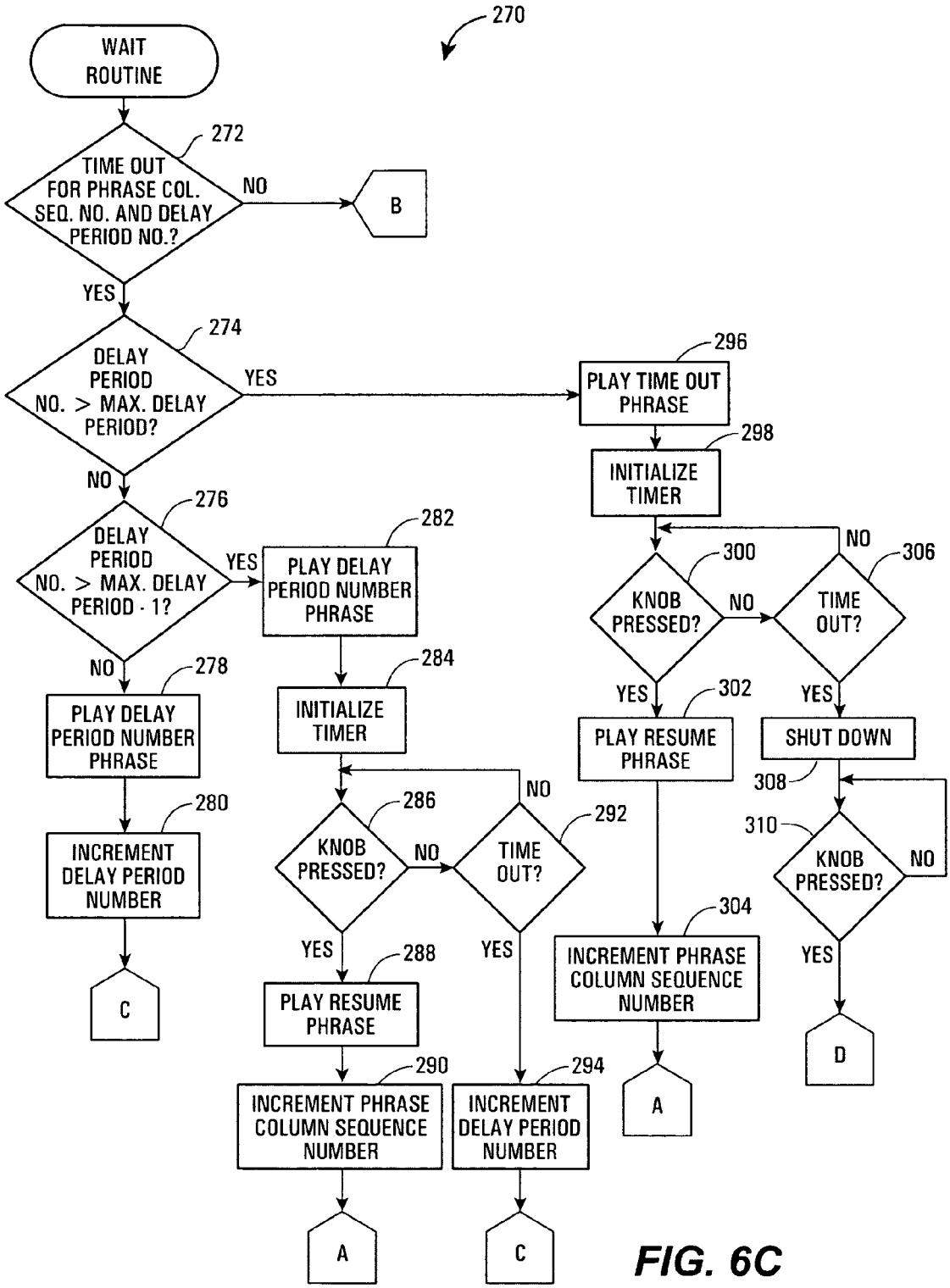
FIG. 6C is a flowchart of an embodiment of a wait routine that may be performed by the electronic instruction unit during the game.

If the controller 100 does not detect the actuation of the activation switch 106 at the block 230, control may pass to the wait routine 270 of FIG. 6C. The wait routine 270 may begin at a block 272 wherein the controller 100 determines whether the delay time period corresponding to the stored phrase column sequence number and stored delay period has expired. The controller 100 may determine the relevant delay time period by finding the phrase column identifier 144 in the table 140 corresponding to the stored phrase column sequence number, and then finding the delay time period 154 corresponding to the stored delay period number in the phrase column 152 in the table 150 corresponding to the phrase column identifier 144 retrieved from the table 140. For example, if the stored phrase column sequence number is initially set to thirteen at the block 224 of routine 200, and the stored delay period number is one, the corresponding phrase column identified 144 from table 140 is "C," and the first delay period 154 in phrase column "C" of table 150 is 45 seconds. In this example, the controller 100 would determine whether 45 seconds had elapsed without a player pressing the knob 24 at the block 272. If the controller 100 determines that the time period has not elapsed, control may return to the block 230 of routine 200 to continue waiting for a player to press the knob 24.

If the delay time period has elapsed at the block 272, control may pass to a block 274 wherein the controller 100 may determine whether the stored delay period number is equal to the maximum delay period number for the phrase column. If the stored delay period number is equal to the maximum, the controller 100 may proceed to execute a time out portion of the wait routine 270, which will be discussed in more detail below. If the stored delay period number is less than the maximum, control may pass to a block 276 wherein the controller 100 may determine whether the stored delay period number is equal to one less than the maximum delay period number for the phrase column. If the stored delay period number is equal to one less than the maximum, the controller 100 may proceed to execute a portion of the wait routine 270 particular to the penultimate delay period, which also will be discussed in more detail below.

If the stored delay period number is less than one less than the maximum, control may pass to a block 278 wherein the controller 100 may output sound generation signals to the speaker 108 corresponding to stored delay period number for the phrase column. Consequently, in the above example for the first delay period of phrase column "C," at the expiration of the 45 second delay period the controller 100 may output sound generation signals for phrase number 32 causing the speaker 108 to broadcast the phrase: "Mmmm, mmmm, mmm, mm, . . . sorry." After the delay phrase is played at the block 278, control may pass to a block 280 wherein the controller 100 may increment the stored delay period number. After the stored delay period number is incremented, control may pass back to the main game play routine at the block 228 wherein the timer may be reset to wait for a player to press the knob 24.

If the delay period number is equal to one less than the maximum delay period number at the block 276, control may pass to a block 282 wherein the controller 100 may output sound generation signals to the speaker 108 to broadcast the penultimate delay phrase number 29 ("(big yawn) Sorry, er . . . are we still playing?"). After playing the penultimate delay phrase, control may pass to a block 284 wherein the controller 100 may reset the timer to provide a time period in which the players may press the knob 24 to acknowledge that the game 10 is continuing. After the timer is reset, control may pass to a block 286 wherein the controller 100 may determine whether the knob 24 of the instruction unit 12 has been pressed by a player and, correspondingly, actuated the activation switch 106 to acknowledge the continuation of the game 10.

If the controller 100 detects the actuation of the activation switch 106 at the block 286, control may pass to a block 288 wherein the controller 100 may output sound generation signals to the speaker 108 to broadcast a resumption phrase, such as phrase number 40 ("Alright! Glad we're still playing, but can you pick up the pace a little?"). After playing the resumption phrase, control may pass to a block 290 wherein the controller 100 may increment the stored phrase column sequence number so that a new sequence of delay phrases may be broadcast while waiting for another player to press the knob 24. Control may then pass back to the main game play routine 200 at the block 226 so that the delay period number may be reset to the first delay period for the new phrase column.

If the controller 100 does not detect the actuation of the activation switch 106 at the block 286, control may pass to a block 292 wherein the controller 100 determines whether the time period has expired for pressing the knob 24 to acknowledge the continuation of the game 10. If the time period has not expired, control may pass back to the block 286 to evaluate whether the activation switch 106 is actuated by a player. If the acknowledgement time period has expired, control may pass to a block 294 wherein the controller 100 may increment the delay period number, and back to the main game play routine 200 at the block 228 wherein the timer may be reset by the controller 100 to wait for a player to press the knob 24.

If the delay period number is equal to the maximum delay period number at the block 274, control may pass to a block 296 wherein the controller 100 may output sound generation signals to the speaker 108 to broadcast the time out phrase 30 ("OK, got to go. Sorry. Bye."). After playing the time out phrase, control may pass to a block 298 wherein the controller 100 may reset the timer to provide a time period in which the players may press the knob 24 to acknowledge that the game 10 is continuing and to prevent the instruction unit 12 from shutting down. After the timer is reset, control may pass to a block 300 wherein the controller 100 may determine whether the knob 24 of the instruction unit 12 has been pressed by a player and, correspondingly, actuated the activation switch 106 to acknowledge the continuation of the game 10.

If the controller 100 detects the actuation of the activation switch 106 at the block 300, control may pass to a block 302 wherein the controller 100 may output sound generation signals to the speaker 108 to broadcast the resumption phrase number 40. After playing the resumption phrase, control may pass to a block 304 wherein the controller 100 may increment the stored phrase column sequence number so that a new sequence of delay phrases may be broadcast while waiting for another player to press the knob 24. Control may then pass back to the main game play routine 200 at the block 226 so that the delay period number may be reset to the first delay period for the new phrase column.

If the controller 100 does not detect the actuation of the activation switch 106 at the block 300, control may pass to a block 306 wherein the controller 100 determines whether the time period has expired for pressing the knob 24 to acknowledge the continuation of the game 10. If the time period has not expired, control may pass back to the block 300 to evaluate whether the activation switch 106 is actuated by a player. If the acknowledgement time period has expired, control may pass to a block 308 wherein the controller 100 may cause the instruction unit 12 to enter a shut down mode and further wait for a player to press the knob 24 and actuate the activation switch 106. As long as the controller 100 does not detect actuation of the activation switch 106 at a block 310, the controller 100 may remain in the shut down mode. When the controller 100 finally detects the actuation of the activation switch 106 in response to a player pressing the knob 24, control may pass back to the main game play routine 200 at the block 204 wherein the introductory phrase may be replayed and to the block 206 wherein the timer may be reinitialized.

The flowcharts illustrate one embodiment of main game play, play next instruction and wait routines that may be programmed into the controller 100 or other memory of the instruction unit 12, and executed by the controller 100. Those skilled in the art will understand that other routines may be implemented in the instruction unit 12 to provide a desired game play for the game 10. For example, the controller 100 of the instruction unit 12 may be programmed to randomly select from a plurality of game instructions stored at the instruction unit 12 instead of selecting the instructions sequentially as illustrated in FIGS. 6A and 6B. Moreover, the instruction unit 12 may be programmed alternate wait routines implementing alternative methods for selecting wait phrases and delay time periods when the instruction unit 12 is not actuated by the players. Such alternative routines are contemplated by the inventor as having use with the game 10 and instruction unit 12 of the present invention.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A method of game play for a game for a plurality of players, the method comprising:

providing an instruction unit and a deck of game cards, wherein each game card has game indicia disposed thereon;

distributing a plurality of the game cards to each participant of the game;

each player in turn comparing the game indicia of the game cards distributed to the player to the game indicia of a top card of a discard pile of the plurality of cards;

discarding at least one of the game cards distributed to the player onto the discard pile in response to the player determining that the game indicia of the player's game cards corresponds to the game indicia of the top card of the discard pile such that the cards may be played on the top card;

actuating the instruction unit to output a game instruction in response to the player determining that the game indicia of the player's game cards does not correspond to the game indicia of the top card of the discard pile such that none of the game cards of the player may be played on the top card, wherein the instruction unit stores a plurality of phrases containing different specific numbers of additional game cards to be drawn from the deck of cards by a player, wherein the instruction unit selects one of the plurality of stored phrases in response to the actuation of the instruction unit by one of the players, and wherein the game instruction output by the instruction unit includes the specific number of additional game cards to be drawn from the deck of cards from the selected one of the plurality of stored phrases; and at least one player drawing the specific number of additional game cards specified in the game instruction from the deck of game cards in response to the game instruction output by the instruction unit.

2. A method of game play for a game as defined in claim 1, wherein at least a plurality of the game cards has one of a plurality of game colors disposed thereon, the method comprising discarding one of the game cards distributed to the player onto the discard pile in response to the player determining that the game color on the player's game card matches the game color of the top card of the discard pile.

3. A method of game play for a game as defined in claim 1, wherein at least a plurality of the game cards has numeric indicia disposed thereon, the method comprising discarding at least one of the player's game cards onto the discard pile in response to the player determining that the numeric indicia of the top card and the player's at least one game card form an ascending or descending numeric sequence beginning with the numeric indicia of the top card of the discard pile.

4. A method of game play for a game as defined in claim 1, comprising:

providing each player with a score-keeping surfaces and a corresponding plurality of game pieces; and moving one of the game pieces onto the player's score-keeping surface in response to the player playing the last of the player's game cards onto the top card of the discard pile.

5. A method of game play for a game as defined in claim 4, comprising selecting by the player a plurality of additional game cards from the deck of game cards if less than all of the player's game pieces have been moved onto the player's score-keeping surface.

6. A method of game play for a game as defined in claim 4, comprising concluding the game if all of the player's game pieces have been moved onto the player's score-keeping surface.

7. A method of game play for a game as defined in claim 1, comprising outputting a delay phrase from the instruction unit in response to the instruction unit not detecting the actuation of the instruction unit by a player within a predetermined period of time.

8. A method of game play for a game as defined in claim 7, comprising:

storing a plurality of delay phrases and corresponding delay time periods at the instruction unit;

outputting one of the delay phrases in response to the instruction unit not detecting the actuation of the instruction unit by a player within the delay time period corresponding to the one of the delay phrases.

9. A method of game play for a game as defined in claim 7, comprising outputting the delay phrases in a predetermined sequence wherein a subsequent delay phrase is output in response to the instruction unit not detecting the actuation of the instruction unit by a player within a predetermined delay time period after outputting the preceding delay phrase.

10. A method of game play for a game as defined in claim 1, comprising:

storing a plurality of game instruction at the instruction unit;

outputting one of the plurality of game instructions at the instruction unit in response to detecting the actuation of the instruction unit by a player.

11. A method of game play for a game as defined in claim 10, comprising retrieving the stored game instructions sequentially in response to detecting the actuation of the instruction unit by a player.

12. A method of game play for a game as defined in claim 1, comprising:

storing a plurality of groups of delay phrases at the instruction unit;

outputting one of the delay phrases of a first group of delay phrases at the instruction unit in response to not detecting the actuation of the instruction unit within a predetermined period of time;

selecting a second one of the groups of delay phrases in response to detecting the actuation of instruction unit by a player; and outputting one of the delay phrases of the second group of delay phrases at the instruction unit in response to not detecting a subsequent actuation of the instruction unit within a subsequent predetermined period of time.

13. A method of game play for a game for a plurality of players, the method comprising:

distributing a plurality of game cards to each player of the game;

sequential players discarding game cards onto a discard pile when possible in accordance with game rules;

sequential players actuating an instruction unit to output a game instruction as determined by game rules, wherein the instruction unit stores a plurality of phrases containing different specific numbers of additional game cards to be drawn from the deck of cards by a player, wherein the instruction unit selects one of the plurality of stored phrases in response to the actuation of the instruction unit by one of the players, and wherein the game instruction output by the instruction unit includes the specific number of additional game cards to be drawn from the deck of cards from the selected one of the plurality of stored phrases; and following the game instruction output by the instruction unit including drawing the specific number of additional game cards specified in the game instruction from the deck of game cards in response to the outputting of the game instruction by the instruction unit.

14. A method of game play for a game as defined in claim 13, wherein at least a plurality of the game cards has one of a plurality of game colors disposed thereon, the method comprising sequential players discarding one of the game cards distributed to the players onto the discard pile in response to determining that the game color on the game cards matches the game color of the top card of the discard pile.

15. A method of game play for a game as defined in claim 13, wherein at least a plurality of the game cards has numeric indicia disposed thereon, the method comprising sequential players discarding at least one of the players' game cards onto the discard pile in response to determining that the numeric indicia of the top card and of the at least one game card form an ascending or descending numeric sequence beginning with the numeric indicia of the top card of the discard pile.

16. A method of game play for a game as defined in claim 13, comprising a player moving a game piece onto a score-keeping surface in response to the player playing the last of the player's game cards onto the top card of the discard pile.

17. A method of game play for a game as defined in claim 13, comprising outputting a delay phrase from the instruction unit in response to the instruction unit not detecting the actuation of the instruction unit within a predetermined period of time.

18. A method of game play for a game for a plurality of players, the method comprising:

distributing a plurality of game cards to each player of the game;

sequential players discarding game cards onto a discard pile or actuating an instruction unit to output a game instruction as determined by game rules, wherein the instruction unit stores a plurality of phrases containing different specific numbers of additional game cards to be drawn from the deck of cards by a player, wherein the instruction unit selects one of the plurality of stored phrases in response to the actuation of the instruction unit by one of the players, and wherein the game instruction output by the instruction unit includes the specific number of additional game cards to be drawn from the deck of cards from the selected one of the plurality of stored phrases; and following the game instruction output by the instruction unit including drawing the specific number of additional game cards specified in the game instruction from the deck of game cards in response to the outputting of the game instruction by the instruction unit.

19. A method of game play for a game as defined in claim 18, wherein at least a plurality of the game cards has one of a plurality of game colors disposed thereon, the method comprising sequential players discarding one of the game cards distributed to the players onto the discard pile in response to determining that the game color on the game cards matches the game color of the top card of the discard pile.

20. A method of game play for a game as defined in claim 18, wherein at least a plurality of the game cards has numeric indicia disposed thereon, the method comprising sequential players discarding at least one of the players' game cards onto the discard pile in response to determining that the numeric indicia of the top card and of the at least one game card form an ascending or descending numeric sequence beginning with the numeric indicia of the top card of the discard pile.

21. A method of game play for a game as defined in claim 18, comprising a player moving a game piece onto a score-keeping surface in response to the player playing the last of the player's game cards onto the top card of the discard pile.

22. A method of game play for a game as defined in claim 18, comprising outputting a delay phrase from the instruction unit in response to the instruction unit not detecting the actuation of the instruction unit within a predetermined period of time.

* * * * *